United States Patent [19]

Lino

[11] 4,050,584

[45] Sept. 27, 1977

[54] SELF-SEALING HOLDER FOR CONTAINERS

[76] Inventor: John Louis Lino, 1535 Anderson Ave., Fort Lee, N.J. 07024

[21] Appl. No.: 652,830

[22] Filed: Jan. 27, 1976

[51] Int. Cl.[2] ..... A47B 73/00; A47G 23/02

[52] U.S. Cl. ..... 211/76; 206/591

[58] Field of Search ..... 206/45.14, 45.19, 521, 206/591; 211/76

[56] References Cited

U.S. PATENT DOCUMENTS

| | | | |
|---|---|---|---|
| 709,819 | 9/1902 | Hicks | 211/76 |
| 1,141,687 | 6/1915 | Brunhoff | 211/76 |
| 2,710,694 | 6/1955 | Carr | 211/76 |

*Primary Examiner*—William T. Dixson, Jr.
*Attorney, Agent, or Firm*—Bernard Franzblau

[57] ABSTRACT

A holder for open containers employs a pair of confronting parallel surfaces one of which supports a resilient material adapted to exert pressure against the open mouth of the container thereby to seal and hold the container in place.

10 Claims, 14 Drawing Figures

SELF-SEALING HOLDER FOR CONTAINERS

BACKGROUND OF THE INVENTION

The present invention relates to a new and improved apparatus for holding and sealing partially filled containers when not in use and more particularly to a holder for soda bottles or the like having means for automatically resealing the open bottle.

The problem of resealing a container partially filled with a liquid under pressure, for example a carbonated beverage (soda), so as to retain the effervescense of the pressurized liquid has resulted in the development of various types of special purpose caps which can be snapped on to the opened bottle in order to provide a substantially air tight seal. A basic defect in the type of solution to the problem, especially in restaurants and other commercial establishments, is that a loose cap is subject to being misplaced or lost and is sometimes rather difficult to snap on or off the opened bottle. This results in wasted beverage, lost time and inefficient utilization of manpower, all of which is undesirable for a well regulated business establishment.

SUMMARY OF THE INVENTION

The present invention provides a versatile, inexpensive, simple and efficient solution to the aforesaid problem and comprises a novel self-sealing holder for bottles or other containers which is capable of sealing said containers without the necessity of saving the original bottle cap or using some other loose cap which is subject to being misplaced etc., as described above. The invention basically comprises a holder having two spaced apart confronting surfaces for supporting an open container or bottle and including at least one resilient surface which automatically forms an air-tight seal about the open end of the container when it is inserted in the holder.

It is therefore an object of the invention to provide a simple and inexpensive holder or support for bottles or other containers with means for automatically sealing the open end thereof in a substantially air-tight manner.

Another object of the invention is to provide a self-sealing bottle holder which can be readily adjusted to accomodate different size bottles.

A further object of the invention is to provide a self-sealing holder for containers which eliminates the need to use individual caps or the like which are subject to being misplaced or lost.

It is a further object of the invention to provide a self-sealing holder which can accept relatively wide mfg. tolerances in the container size and still provide a good sealing action.

As will become evident from the following detailed description of the invention, the novel apparatus has many useful applications. It can be mounted as a counter top or under the counter unit. It can be part of a subassembly built into a refrigerator. The holder can be designed in various shapes and sizes, i.e. round, square, rectangular, as a single line unit or as a double line (i.e. back-to-back) unit etc.. It can be used to hold and seal containers of both liquid and solid substances, for example, soda, wine, paint, milk, vitamin pills, spices etc.. The device can be secured to various surfaces or it can be made portable for use at picnics etc. by providing a handle therefor.

Other objects, advantages and features of the invention will become apparent from the following detailed description considered in conjunction with the accompanying drawings.

BRIEF DESCRIPTION OF THE DRAWINGS

FIGS. *2a, 2b,* and *2c* illustrate certain details of the holder of FIG. 1.

Referring now to FIGS. 1 and 2 of the drawing, a self-sealing holder for soda bottles or other containers is fabricated from a unitary generally U-shaped frame 1 made of a material that is relatively strong and inexpensive, for example, a piece of one quarter inch plexiglass or heavy gauge stainless steel. The frame 1 consists of a back plate 2 and two opposed confronting surfaces, a top plate 3 and a base member 4.

Figure 2A:
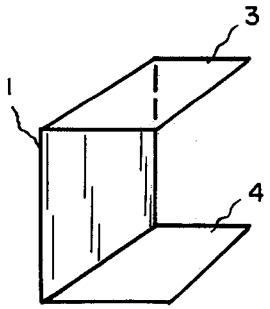
Figure 2C:
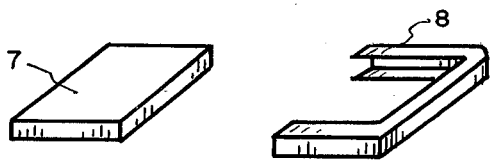
Figure 2B:
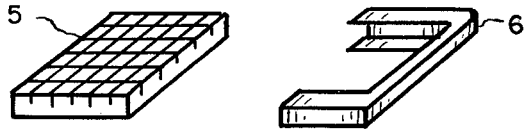

A pad 5 made of a resilient yieldable material is mounted on the base member 4 by any suitable fastening means such as an adhesive material or screws. In order to facilitate the replacement of a worn out pad, the rectangular pad 5 may be fixed to the base member by means of a U-shaped pad holder 6 having channels for receiving the pad, as shown in detail in FIG. 2. The pad may be made of rubber coated or plastic coated polyurethane foam, sponge rubber, foamed plastic or other resilient readily deformable substance. The pad also may consist of a spongelike base covered by a strong thin layer of resilient or other material that is smooth and exhibits good resistance to friction and wear. The top surface of pad 5 may contain a grid-like pattern of parallel slits which allows for a variation in the size of the containers to be supported and provides good operation of the device by preventing tilting of the pad which would otherwise upset the seal of an adjacent container. The slits are not essential to the proper operation of the invention. In fact, the bottom resilient pad may be omitted altogether and still obtain the benefits of the invention. The main function of the bottom resilient member is to provide additional resiliency to compensate for small variations in the height of the bottles or containers to be supported.

A pad 7 also made of a resilient yieldable material is secured to the top plate 3 by any suitable securing means. In a manner similar to that of the bottom pad, the top resilient pad 7 may be fixed to the top plate by means of a channeled U-shaped pad holder 8, shown in detail in FIG. 2. The top and bottom pad holders may be made of metal, plastic or other suitable rigid material.

In operation, the open end of a soda bottle or other opened container is forced up into the resilient pad 7 at a slight angle. The bottom end of the bottle is then rotated into the base member 4 until the bottle is in a vertical position with the bottle top contacting pad 7 and the bottom contacting pad 5, whereupon the bottle is released. The bottle will now be held firmly in a vertical position by the forces exerted by the resilient pads 7 and 5. Simultaneously, the top resilient pad 7 forms an air-tight seal about the open end of the bottle thereby preserving the carbonation in the case of a partially filled soda bottle.

Figure 3:
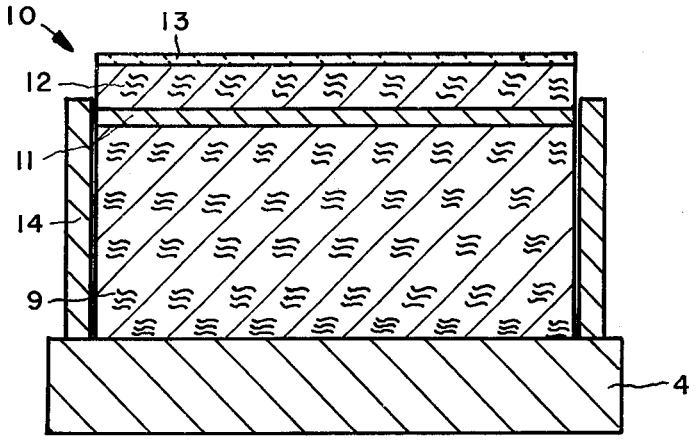
FIG. 3 is a sectional view of a modified form of bottom support for the holder, FIGS. *4a* and *4b* illustrate top and side views of a modified form of the resilient top support member for sealing the container.

In order to facilitate the insertion and removal of a bottle from the holder, a modification of the bottom pad and holder, as shown in FIG. 3, may be utilized. In FIG. 3, the bottom resilient member consists of a relatively thick spongy material 9 supported on the base member 4. The top surface of the spongy material 9 supports a relatively thin, flat unitary piece 10 composed of laminations 11, 12, and 13, in the order named. The flat lamination 11 consists of a rigid plate made of sheet metal or the like which rests directly on the surface of the sponge member 9. Next comes a thin layer of resilient sponge rubber material 12 sandwiched between the plate 11 and a further rigid plate 13. The lamination 13 is composed of a smooth material such as Teflon which allows the bottle to slide easily along its surface and thus facilitates the insertion and removal thereof from the holder. Lamination 13 may be only ⅛ to ¼ inch thick. The members 9 and 12 are restrained from expanding laterally by means of a frame made up of four side wall 14 extending from the base member 4 to a height somewhat below the interface between laminations 12 and 13 in the unstressed condition of the apparatus (minus any bottles). In this way the side walls 14 will not interfere with the insertion of a bottle into the holder apparatus. The side walls retain the thick spongy material in place and improve the resiliency of the apparatus by preventing lateral expansion thereof. The various laminations may be secured together by means of an adhesive substance, screws, or other suitable means. Best results are obtained when the spongy member 9 is thicker than the resilient member 12. The resilient laminated bottom support structure of FIG. 3 allows for a relatively wide variation in the length of a bottle to be accomodated in the holder. The rigid plate 11 assists in maintaining a good seal about the open end of the bottle because it restricts the amount of bottle tilt possible. The thin spongy layer 12 cooperates with the smooth layer 13 in reducing the resistance when a bottle is inserted and also helps compensate for bottle tilt.

In the case where the expected variation in bottle height is not too great, the members 9 and 11 may be omitted and the bottom resilient support will the consist merely of a 2-part member composed of laminations 12 and 13 secured to the base member. In this modification the side walls 14 are not required since there is relatively little lateral expansion of the thin spongy lamination 12.

Figure 1:
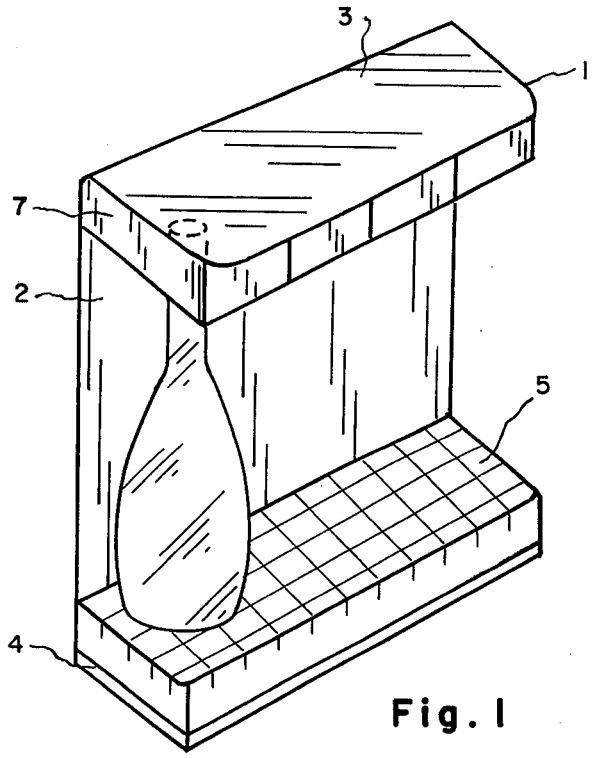
FIG. 1 is a perspective view of a self-sealing holder for soda bottles.
Figure 4A:
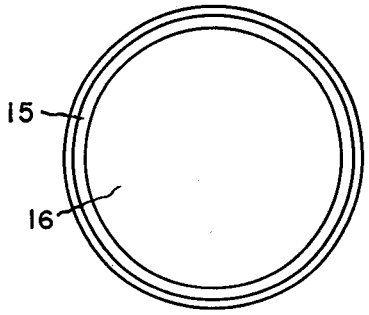
Figure 4B:
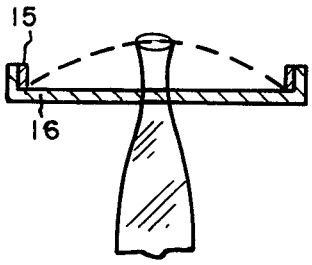

Referring now to FIG. 4, another embodiment of the invention is shown in which the top plate 3 consists of a ringshaped member 15 which supports about its periphery a thin membrane 16 composed of a resilient material, e.g. surgical rubber sheet or a rubber latex membrane. When a soda bottle or the like is inserted into the holder, it deforms the resilient membrane 16 upward in the manner indicated by the dashed line, thereby forming an air-tight seal about the open end of the bottle while simultaneously exerting a downward force to hold the bottle in place. It has been found that with this construction it is possible to maintain an effective air-tight seal even in the case where the bottle is not supported in a precisely vertical position, i.e. when the bottle is inadvertently inserted and left in the holder so as to form a small angle to the true vertical position. In other words, the embodiment of FIG. 4 provides a greater compensation for bottle tilt than does the embodiment of FIG. 1.

Alternatively, the ring-shaped top plate and resilient membrane of this embodiment may consist instead of two thin flat metal rings sandwiching a thin resilient membrane therebetween and fastened together to form a single unitary member. This construction provides a superior support structure for the membrane 16. A modification of the "sandwich" arrangement comprises two thin flat resilient membranes sandwiched together between the two metal rings. The membrane arranged to contact the container is made of a more resilient material than that of the other membrane. The metal rings and membranes may be held together by a plurality of screws spaced about the periphery of the metal rings.

Figure 5:
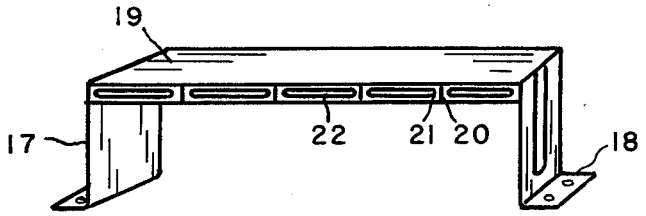
FIG. 5 is a diagrammatic view of another embodiment of the invention using a series of resilient members each having an interior air pocket.

FIG. 5 illustrates diagrammatically another modified form of the top resilient support member which is especially useful for holding and sealing relatively widemouthed containers, such as jars or paint cans. Although this embodiment is designed to be mounted directly on a table top having a hard, smooth surface, it is clear that it could be constructed similar to the device of FIG. 1 which has its own individual base support member 4. The apparatus of FIG. 5 comprises a vertical bracket 17 having a pair of horizontal support flanges 18 extending therefrom for mounting the bracket to a table top work surface. A rigid top plate 19 extends from the bracket 17 to form a parallel confronting surface to the surface of the table top when the bracket is mounted thereon. The plate 19 includes a plurality of partition walls 20 extending approximately parallel to the vertical walls of bracket 17 to subdivide the top plate into a series of separate compartments. Each compartment contains a yieldable member 21 consisting of a resilient material such as sponge or foam rubber or other suitable resilient plastic material molded into a generally rectangular shape with an interior air pocket 22 formed therein. The partition walls 20 provide lateral support for resilient members 21. The top plate 19 preferably has vertically extending front and back lips, not shown, to provide additional lateral support for the members 21. The bottom surface of each member 21 is exposed to provide a resilient yieldable contact surface for sealing the open end of a container placed in the holder apparatus. As mentioned above, the device of FIG. 5 provides exceptionally good sealing action for widemounted containers because the internal air pocket provides a more readily deformable contact surface than a solid spongy material. Another modification of this arrangement is to mold a first resilient material about a second very spongy material so that in place of the air pocket there is formed a core of spongy material. In this case the resiliency of the internal core material is preferably greater than the resiliency of the surrounding material. This allows one to chose each of the resilient materials to best satisfy the particular requirements, e.g. the outer surface should have good wearing qualities whereas the core material will be chosen primarily for its resilient characteristics.

Figure 6:
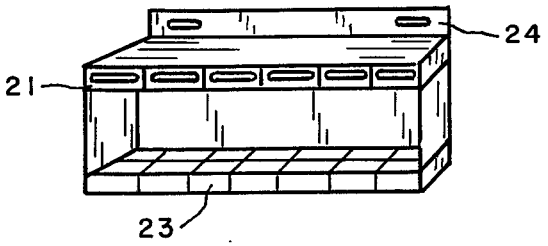
FIG. 6 is a diagrammatic view of a modified form of the device shown in FIG. 5.

FIG. 6 diagrammatically illustrates a modified form of the embodiment of FIG. 5 that is suitable for mounting on a wall and contains its own base member. As desired, the base member may or may not include a resilient bottom layer 23, which if present may, for example, be of the type described with reference to the embodiments of FIGS. 1, 2 or 3. The holder may be mounted to a wall by means of flange 24. The optional bottom resilient member also may be constructed out of a molded resilient material having air pockets in a manner similar to the top resilient support member 21.

In the embodiments of FIGS. 5 and 6, the bottom wall surface of the top resilient member 21 is preferably thinner than its side or top walls so that, in a manner analogous to that of the "ring" embodiment of FIG. 4, the bottom surface can readily form about the lip of the bottle to make a tighter seal. The apparatus shown in FIGS. 5 and 6 provides better sealing action for wide-mouthed containers than does the device of FIG. 4 because a greater reverse pressure is needed in this case to obtain a good sealing action. In the devices of FIGS. 5 and 6 a greater reverse pressure is obtainable because the air within the air pocket is compressed, whereas in the device of FIG. 4 there is only normal atmospheric air pressure exerted on the upper surface of the deflected thin membrane 16. It will obvious that the improvements derivable from the apparatus of FIGS. 5 and 6 are not limited to a rectangular shaped top resilient member 21, but various other shapes can be readily devised to accomodate containers of different configurations etc.. Other modified forms of the bottom reslient member also are contemplated and fall within the scope of my invention. For example, where it is desired to seal heavy containers it is possible to mount a spongy resilient material on a flat plate that rolls on a track, similar to the operation of a drawer in a filing cabinet. This apparatus makes it relatively easy to slide a heavy container in and out of the holder since the container is supported on the movable bottom resilient member. Another possible modification is to use a plastic or sheet metal box with a plurality of springs fixed therein as the bottom resilient member. A thin teflon surface or the like is placed over the springs to form a smooth base support for the container.

Figure 7:
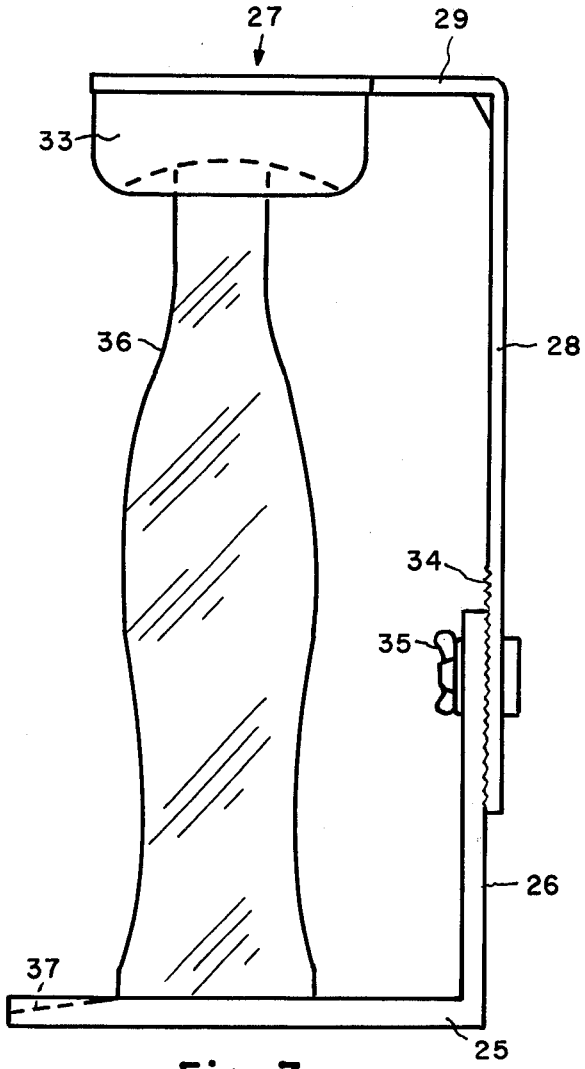
FIG. 7 is a side view of a further embodiment of the invention which is adjustable to accomodate different size containers.
Figure 8:
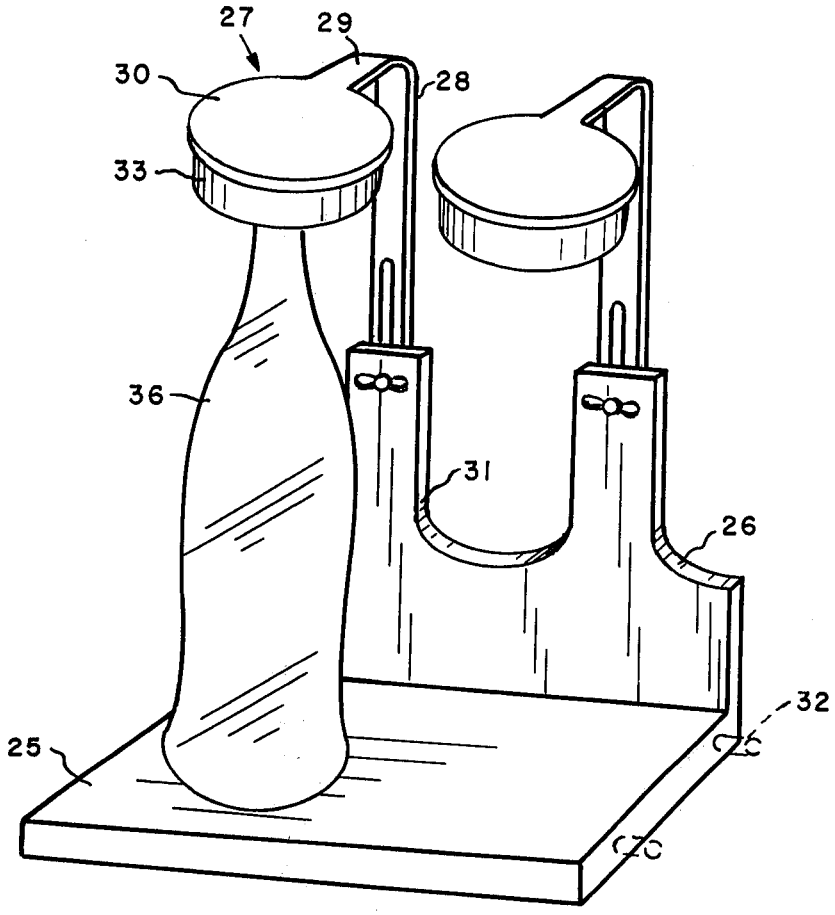
FIG. 8 is a front view of the embodiment of FIG. 7.

Referring now to FIGS. 7 and 8 of the drawing, there is illustrated a self-sealing holder for soda bottles that includes a rectangular shaped base member 25 with a vertically extending back plate 26. The base and back plate may have other desired shapes than that illustrated in FIGS. 7 and 8. A top plate 27 is mounted approximately parallel to the base member 25 by means of a vertically extending leg member 28 that is supported on a vertical leg 31, as shown. The top plate 27 consists of a horizontal extension 29 of the leg 28 and a circular plate 30. It is preferable to form legs 28, 29 and circular plate 30 as a unitary structure. The back plate 26 may comprise one or more of the legs 31 (FIG. 8) depending upon the number of bottles to be supported in the holder. The base member 25 has one or more pegs 32 extending from a side edge thereof. These pegs are arranged to mate with corresponding holes in the side edge of the base member of a further holder (not shown) whereby the holding capacity of the apparatus can be expanded at will. The opposite side edge of the base member may contain one or more holes, not shown, which are adapted to mate with corresponding pegs in the base of yet another bottle holder.

A pad 33 made of a resilient yieldable material is fixed to the top plate 30 by any suitable fastening means. The pad may be made of sponge rubber or a foamed plastic base covered with a strong, thin layer of resilient material such as a plastic skin having good wear properties. Other readily deformable resilient substances are suitable for the top pad, including plastic coated polyurethane foam.

In order to adjust the holder for bottles of different size, the vertical leg members 31 and 28 contain mating teeth 34 and a wing nut arrangement 35 for clamping the two vertical legs together. The toothed legs 31 and 28 and the adjustable clamping member 35 provide a means for adjusting the spacing between the horizontal confronting surfaces of the base 25 and the top plate 27 so that the holder can be readily adjusted to accomodate bottles having substantially different linear dimensions. A soda bottle 36 is shown supported in place in the self-sealing bottle holder. The bottle holder may be secured to a counter top by means of screws or other suitable fasteners, now shown.

The operation is similar to that described above for FIGS. 1 and 2. The open end of the soda bottle is forced up against the resilient top plate 33 at a slight angle and then the bottom end is rotated into the base member until the bottle is in a vertical position, whereupon it is released. The bottle is held in positon by the force exerted by the resilient member 33, which simultaneously forms and air-tight seal about the open end of the soda bottle to preserve the effervescence of any soda left therein. In order to facilitate the insertion and removal of the bottle from the holder, it may be desirable to cut away a small wedge-shaped portion at the front of the base, as indicated by the dashed line 37 in FIG. 7. As in the embodiments described earlier, it is also possible to secure a resilient member to the base if it is desired to increase the sealing pressure and provide a greater tolerance in the height of the bottles to be accomodated in the bottle holder. However, in many cases a single resilient top plate is sufficient to achieve the objects and advantages of the invention. The top plate also may be modified to use the ring and resilient membrane support shown in FIG. 4 or the air pocket arrangement of FIGS. 5 and 6.

Figure 9:
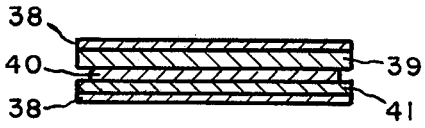
FIG. 9 is a sectional view of a modified form of resilient top support structure especially useful for sealing containers holding a liquid under pressure, and FIG. 10A and 10B diagrammatically show first and second operative positions of a further embodiment of the invention wherein the top plate is normally in an open position to expedite the insertion of a container into the holder and includes means for automatically rotating the top plate into its closed or sealing position.

If one were to use the ring and thin resilient membrane of FIG. 4 in order to seal a container holding a liquid under pressure, for example a partially filled soda bottle, it has been found that the gas pressure sometimes caused to bubble to form in the membrane 16. The bubble could be eliminated by making the resilient membrane thicker, but it has been found that this solution reduces the sealing action about the mouth of the bottle. In accordance with a further feature of the invention, as shown in FIG. 9, I provide a pair of rigid rings 38 that sandwich together a laminated resilient structure consisting of a heavy rubber latex member 39, a circular polyurethane foam cushion 40 and a thin rubber latex membrane 41. This laminated structure prevents the formation of a bubble and still provides excellent sealing action for the carbonated soda or the like. The apparatus of FIGS. 7 and 8 can be readily modified to use the ring and laminated membrane structure of FIG. 9 in place of the top plate 30 and resilient pad 33 of said apparatus.

Figure 10B:
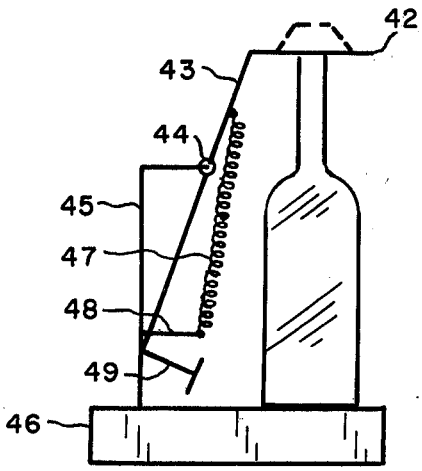
Figure 10A:
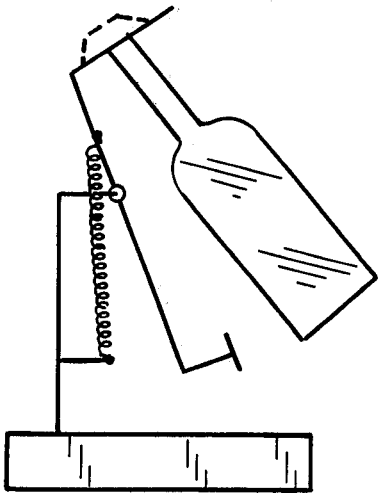

FIGS. 10A and 10B illustrate diagrammatically another modification of the invention wherein I provide means for tilting the top plate upwards to further facilitate the insertion of the container into the holder. FIG. 10A illustrates a bottle in the process of being inserted in the holder, whereas FIG. 10B shows the bottle supported in place to provide the desired sealing action. In this Figure, the top plate 42 may consist of a ring and resilient membrane structure of the type described above. A support member 43 is pivotally mounted at point 44 to a support bracket 45 that is in turn fixed on a base plate 46. A spring 47 is secured at its upper end to the member 43 and at its lower end to a further support member 48 mounted on the bracket 45. The member 43 has a portion 49 extending therefrom to engage the bottom part of the bottle. To operate the apparatus, a bottle is pressed into the resilient membrane as shown in FIG. 10A and is rotated towards the bracket 45. The spring 47 causes the member 43 to snap into the position shown in FIG. 10B with the bottom end abutting bracket 45. The spring holds the member 43 in position thus sealing the resilient membrane of the top plate 42 about the open end of the bottle, as shown. The bottle is removed by grasping the bottom end and rotating it away from the bracket 45. Other techniques for automatically rotating the top plate so as to expedite the insertion and removal of a container from the holder will become apparent from the foregoing description of the illustrative embodiment of FIG. 10.

In view of the foregoing it will be evident that the present invention accomplishes the objects and advantages enumerated above. It also will be apparent to one skilled in the art that various changes and modifications may be made in the invention without departing from the true spirit and scope thereof and therefore the invention is not to be limited to the apparatus illustrated in the drawing and described in the specification, but only to the extent indicated in the accompanying claims.

What is claimed is:

1. A self-sealing holder for containers comprising, a first support member having a generally planar surface and a first resilient deformable material having a generally planar surface and fixed to the first support member, said resilient deformable material being adapted to exert pressure against the open mouth of a container placed in contact therewith, a second support member having an adjustable leg that is approximately perpendicular to and secured to the first support member and with a base member extending from the second support member and having a flat surface that forms a second generally planar surface parallel to and spaced apart from the first planar surface with the resilient material facing said second planar surface so that the two facing surfaces will seal and retain in position a container inserted therebetween, said leg being adjustable so as to vary the parallel spacing between the first and second generally planar surfaces.

2. A holder as claimed in claim 1 further comprising a second resilient deformable material secured to the flat surface of said base member whereby the first and second resilient materials exert opposing forces on a container placed therebetween

3. A holder as claimed in claim 1 wherein the spacing between the confronting surfaces of the first resilient material and the base member is less than the length of a container to be supported therebetween.

4. A self-sealing holder for containers comprising, a first member means having a generally planar surface including a resilient deformable material adapted to exert pressure against the open mouth of a container placed in contact therewith, wherein said first member means comprises a ring-shaped support member and a relatively thin resilient membrane supported thereon so as to cover the hole in the ring-shaped member, and means for mounting said first member means so that said planar surface is parallel to and spaced apart from a second generally planar surface with the resilient membrane confronting said second planar surface so that the two confronting surfaces will seal and retain in position a container inserted therebetween.

5. A holder as claimed in claim 4 wherein said first member means further comprises a second ring-shaped support member, a second spongy resilient sheet member, and a third resilient sheet member, said first, second and third resilient members being sandwiched and held together between said first and second ring-shaped members in the order named.

6. A holder a claimed in claim 5 wherein said first member means further comprises a second ring-shaped support member, and a second resilient member which is thicker than said thin resilient membrane, said resilient membrane and said second resilient member being spaced apart and sandwiched and held together between said first and second ring-shaped members.

7. A self-sealing holder for containers comprising a first support member having a generally planar surface and a first resilient deformable material having a generally planar surface and fixed to the first support member, said resilient deformable material being adapted to exert pressure against the open mouth of a container placed in contact therewith, a second generally planar surface parallel to and spaced apart from the first planar surface with the resilient material facing said second planar surface so that the two facing surfaces will seal and retain in position a container inserted therebetween, a spongy resilient material secured on the second planar surface, a thin rigid plate covering said spongy resilient material, a thin resilient material covering said thin rigid plate and having a relatively smooth flat surface facing the first resilient material, and a pair of opposed side walls extending at right angles to said second planar surface so as to restrain said spongy resilient material from expanding laterally.

8. A self-sealing holder for containers comprising a first support member having a generally planar surface and a first resilient deformable material having a generally planar surface and fixed to the first support member, said resilient deformable material being adapted to exert pressure against the open mouth of a container placed in contact therewith, said first resilient material comprising a separately formed interior air pocket, a second generally planar surface parallel to and spaced apart from the first planar surface with the resilient material facing said second planar surface so that the two facing surfaces will seal and retain in position a container inserted therebetween.

9. A holder as claimed in claim 7 wherein said air pocket contains a fluid medium therein.

10. A holder a claimed in claim 8 wherein said first resilient material comprises a plurality of thin flat members arranged side by side to form said generally planar surface, each of said thin flat members being formed with an interior air pocket.

* * * * *